US005178519A

United States Patent [19]

Kawasaki et al.

[11] Patent Number: 5,178,519

[45] Date of Patent: Jan. 12, 1993

[54] CERAMIC TURBO CHARGER ROTOR AND METHOD OF MANUFACTURING THE SAME

[75] Inventors: Kiyonori Kawasaki, Kani; Masahiro Fujiyama, Yokkaichi; Hiroyuki Kawase; Koji Kato, both of Nagoya, all of Japan

[73] Assignee: NGK Insulators, Ltd., Japan

[21] Appl. No.: 641,408

[22] Filed: Jan. 15, 1991

[30] Foreign Application Priority Data

Jan. 17, 1990 [JP] Japan ..... 2-6361
Jan. 11, 1991 [JP] Japan ..... 3-12655

[51] Int. Cl.[5] ..... F01D 5/14
[52] U.S. Cl. ..... 416/241 B; 415/216.1
[58] Field of Search ..... 416/241 B, 223 R; 415/216.1, 217.1, 200

[56] References Cited

U.S. PATENT DOCUMENTS 4,550,004 10/1985 Mizuno ..... 416/241 B
4,552,510 11/1985 Takeyuki ..... 416/241 B
4,597,926 7/1986 Ando et al. ..... 416/241 B
4,878,812 11/1989 Kito et al. ..... 416/241 B

FOREIGN PATENT DOCUMENTS 2022120 11/1971 Fed. Rep. of Germany .
53401 3/1986 Japan .
164001 7/1986 Japan .
83155 3/1990 Japan .

*Primary Examiner*—John T. Kwon
*Attorney, Agent, or Firm*—Parkhurst, Wendel & Rossi

[57] ABSTRACT

A ceramic turbo charger rotor having a blade portion including a shroud tip portion and a top portion, a back plate portion arranged rear of the blade portion, and a shaft portion arranged to the back plate portion is manufactured by working only a part of a back plate portion as a standard surface or by working only a top surface of the tip portion as a standard surface while no working is applied for the back plate portion, so as to reduce a total manufacturing cost.

2 Claims, 2 Drawing Sheets

CERAMIC TURBO CHARGER ROTOR AND METHOD OF MANUFACTURING THE SAME

BACKGROUND OF THE INVENTION

1. Field of the Invention

The present invention relates to a ceramic turbo charger rotor comprising a blade portion including a shroud tip portion, a back plate portion arranged rear of the blade portion and a shaft portion extending from the back plate portion at an opposite side with respect to the wing portion, and relates to a method of manufacturing the same.

2. Related Art Statement

As for automobile parts, use is made of ceramic materials having characteristics such as an excellent high temperature strength, an excellent thermal resistance and a light weight as compared with metal materials. Especially, it is well known that ceramic turbo charger rotors made of silicon nitride show superior characteristics of high temperature strength, thermal resistance and reliability.

Generally, since turbo charger rotors made of ceramic materials have complicated shapes, a rotor having the blade portion including the shroud tip portion, the back plate portion and the shaft portion is manufactured in the following manner. First, the rotor is formed by using an injection molding method and the formed body is preliminarily heated to eliminate organic binders and the like. Then, the thus preliminarily heated body is sintered under a condition such that the shaft portion thereof is inserted into a cylindrical holder for a support, and the sintered body is worked into a final shape.

In this manufacturing method, it is necessary to grind not only the shaft portion which is to be inserted into a metal member and the shroud tip portion of the blade portion but also a rear portion of the blade portion and the back plate portion, as the reasons described below.

(1) In the metal turbo charger rotor, it is considered that a position of the rear portion of the blade portion must be controlled strictly so as to obtain a good acceleration responsibility. This consideration is maintained in the ceramic turbo charger rotor.

(2) Since the back plate portion is sometimes broken during a rotation examination if the rear portion and the back plate portion are in an as fired state, it is necessary to grind the rear portion and the back plate portion so as to make them stronger.

(3) Since a standard surface for use in working the rear portion and installation of the metal member must be arranged on the back plate portion, it is necessary to grind the rear portion of the blade portion.

However, since ceramic materials have harder and more brittle characteristics than those of metal materials, especially since the back plate portion has a complicated shape such as an oval shape or a tapered shape to reduce generation of stresses, the working of the ceramic turbo charger rotor such as grinding and polishing is very difficult and becomes expensive. As a result, a total cost of manufacturing the ceramic turbo charger rotor becomes expensive as compared with the metal turbo charger rotor.

In this regard, in order to reduce transformation of the ceramic sintered body and a decrease in strength, there are disclosed a method of effecting an isostatic pressing for the formed body before the sintering in Japanese Patent Publication No. 62-27034 and a method of sintering for reducing vaporization and decomposition of the binders in Japanese Patent Publication No. 61-3304. However, both of these references do not disclose a sintered body which needs no working.

Moreover, when the rear portion of the blade portion is worked, chipping is liable to be generated at a boundary portion between the shroud tip portion and the rear portion, and thus it is necessary to work and smooth the boundary portion to obtain a dull boundary portion. Further, if the ceramic turbo charger rotor, the rear portion of which is not worked, is rotated to effect a proof examination, the ceramic turbo charger rotor is often broken.

SUMMARY OF THE INVENTION

An object of the invention is to eliminate the drawbacks mentioned above and to provide a ceramic turbo charger rotor and a method of manufacturing the same in which total manufacturing cost thereof can be reduced and a decrease in strength thereof is small.

According to a first aspect of the invention, a ceramic turbo charger rotor having a blade portion including a shroud tip portion, a back plate portion arranged rear of said blade portion, extending from and a shaft portion said back plate portion, comprises a back plate portion wherein only a part thereof is worked for a standard surface and the other portions are maintained in an as fired state.

According to a second aspect of the invention a method of manufacturing a ceramic turbo charger rotor having a blade portion, a back plate portion and a shaft portion in which only a part thereof is worked, and a shaft portion comprises the steps of:

preparing raw ceramic powders;

forming said raw ceramic powders to obtain a ceramic turbo charger rotor formed body having a blade portion including a shroud tip portion, a back plate portion arranged rear of said blade portion, and a shaft portion extending from said back plate portion;

sintering said ceramic turbo charger rotor formed body under such a condition that said shaft portion is inserted into a cylindrical support member made of silicon nitride so as to support said back plate portion by said cylindrical support member; and working a contacted portion of said back plate portion between said back plate portion and said cylindrical support member to obtain a standard surface.

According to a third aspect of the invention, a ceramic turbo charger rotor having a blade portion including a shroud tip portion and a top portion, a back plate portion arranged rear of said blade portion, and a shaft portion extending from said back plate portion, comprises a top portion wherein only a top surface portion thereof is worked for a standard surface and the other portions are maintained in an as fired state; and no working is applied to the back plate portion, which is maintained an as fired state.

According to a fourth aspect of the invention, a method of manufacturing a ceramic turbo charger rotor having a blade portion including a top portion in which only a surface thereof is worked, a back plate portion and a shaft portion comprises the steps of:

preparing raw ceramic powders;

forming said raw ceramic powders to obtain a ceramic turbo charger rotor formed body having a blade portion including a shroud tip portion and a top portion, a back plate portion arranged rear of said blade portion, and a shaft portion extending from said back plate portion;

sintering said ceramic turbo charger rotor formed body under such a condition that said top portion of said blade portion is supported by a support member; and working a top contacted surface of said top portion between said top portion and said support member to obtain a standard surface.

In the ceramic turbo charger rotor according to the first aspect of the invention, if only a part of the back plate portion is worked as a standard surface and the other portion of the back plate portion and the rear portion of the blade portion is not worked, it is found, as apparent from the following embodiments, that the ceramic turbo charger rotor according to the first aspect of the invention has the substantially same ability as that of the conventional ceramic turbo charger rotor to which the working of all the back plate portion and all the rear portion is applied and no disadvantages are shown in real use. This is because we found that the ceramic turbo charger rotor has the same acceleration responsibility as that of the conventional ceramic turbo charger rotor even if the position of the rear portion is not so strictly controlled as the metal turbo charger rotor.

Therefore, the ceramic turbo charger rotor according to the first aspect of the invention can reduce working cost and thus total manufacturing cost. Especially, since the shape of the back plate portion is a cone shape such that a thickness thereof becomes gradually thicker from a peripheral portion of the blade portion to the shaft portion, it is necessary to use a grinder having the same complicated shape as that of the back plate portion if all the back plate portion is to be ground, and thus the working of the back plate portion is difficult and expensive. Therefore, it is very effective for reducing the manufacturing cost that the ceramic turbo charger rotor having no disadvantages such as strength degradation during real use can be obtained according to the first aspect of the invention wherein only a part of the back plate portion is ground.

Moreover, in the method of manufacturing the ceramic turbo charger according to the second aspect of the invention, since the sintering step is performed by using the cylindrical support member made of silicon nitride, a rough portion of a connecting portion between the back plate portion and the support member in the vicinity thereof, due to a reaction between silicon carbide and silicon nitride, generated when use is made of the support member made of silicon carbide as usual, can be eliminated, and thus it is possible to reduce the decrease is strength.

It should be noted that, when the number of sintering is increased, a rough portion due to a decomposition of the binder is generated on a connecting surface of the support member even though a support member made of silicon nitride is used. Therefore, vaporization of the binder and the like becomes aggressive from a boundary surface of the back plate portion to which the support member is contacted, and thus the boundary surface takes on a rough state. However, in the ceramic turbo charger rotor according to the invention, the rough boundary surface is only worked to obtain the standard surface and thus no disadvantages due to the rough boundary surface occur. In the ceramic turbo charger rotor according to the first aspect of the invention, a position of the standard surface can be anywhere on the back plate portion, but it is better to arrange it on a position at which a minimum stress generation during the rotation is realized.

Further, in the ceramic turbo charger rotor according to the third aspect of the invention, if the rear portion of the blade portion and the back plate portion are not worked at all and maintained in an as fired state by arranging the standard surface to the top portion of the blade portion, it is found, as apparent from the following embodiments, that the ceramic turbo charger rotor according to the third aspect of the invention has substantially the same ability as that of the conventional ceramic turbo charger rotor to which working of all the back plate portion and all the rear portion is applied and no disadvantages are shown in real use. This is because we found that the ceramic turbo charger rotor has the same acceleration responsibility as that of the conventional ceramic turbo charger rotor even if the standard surface is arranged anywhere other than the back plate portion.

That is to say, it is found that, in the ceramic turbo charger rotor, the same acceleration responsibility as that of the conventional ceramic turbo charger rotor can be realized even if the rear portion is not so strictly controlled as the metal turbo charger rotor and also the rear portion and the back plate portion are not worked at all and maintained in an as fired state. Further, in the ceramic turbo charger rotor according to the third aspect of the invention, since the position of the standard surface is changed and it is arranged on the top portion of the blade portion, it is not necessary to grind the back plate portion at all.

Moreover, in the method of manufacturing the ceramic turbo charger rotor according to the fourth aspect of the invention, since the formed body is sintered under such a condition that the top portion of the blade portion is supported by the support member, a rough surface on the top portion is ground to obtain the standard surface, and thus no disadvantages due to the rough surface occur. In this case, it is considered that the shroud portion is affected for measuring a working distance from the standard surface. Therefore, it is preferred that a working standard surface is once arranged on a metal member on the basis of the standard surface and then working of the metal member is performed on the basis of the working standard surface.

DESCRIPTION OF THE PREFERRED EMBODIMENTS

Figure 1A:
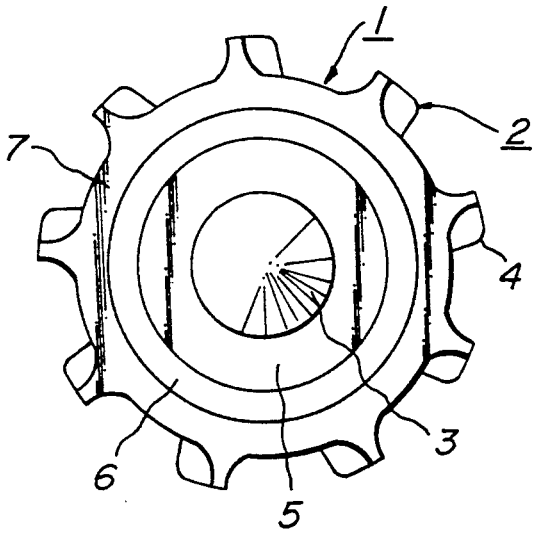
FIGS. 1*a* and 1*b* are a rear view and a side view respectively showing one construction of a ceramic turbo charger rotor according to a first aspect of the invention.
Figure 1B:
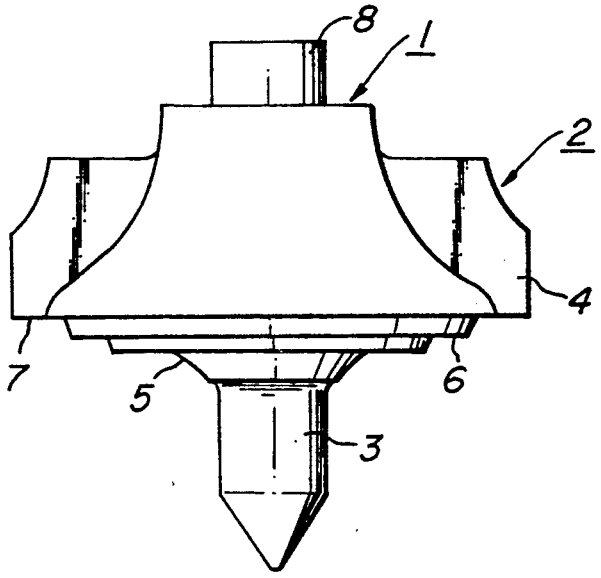

FIGS. 1*a* and 1*b* are a rear view and a side view respectively showing one construction of a ceramic turbo charger rotor according to a first aspect of the invention. In FIGS. 1*a* and 1*b*, a ceramic turbo charger rotor 1 made of silicon nitride, for example, comprises a blade portion 2, a back plate portion 5 and a shaft portion 3, and the blade portion 2 comprises a shroud tip portion 4 and a rear portion 7. The back plate portion 5 has a cone shape such that a thickness thereof becomes gradually thicker from a peripheral portion of the shroud tip portion 4 to the shaft portion 3.

In the ceramic turbo charger rotor 1 according to the first aspect of the invention, a working after a sintering step is effected for all the shroud tip portion 4 and all the shaft portion 3, but not for the back plate portion 5 except for a standard surface 6. Therefore, the back plate portion 5 other than the standard surface 6 is maintained in an as fired state. That is to say, in the back plate portion 5, a portion for generating the standard surface 6 is only ground after the sintering step. Therefore, a portion of the back plate portion 5 to be ground can be reduced extremely as compared with the conventional turbo charger rotor wherein all the back plate portion 5 is ground. Moreover, since a shape of the portion to be ground for the standard surface 6 i not complicated, a grinding operation can be performed easily. The reason for arranging the standard surface 6 is that it is necessary to provide a surface for use as a standard when a distance is measured in working and installing steps.

Figure 2:
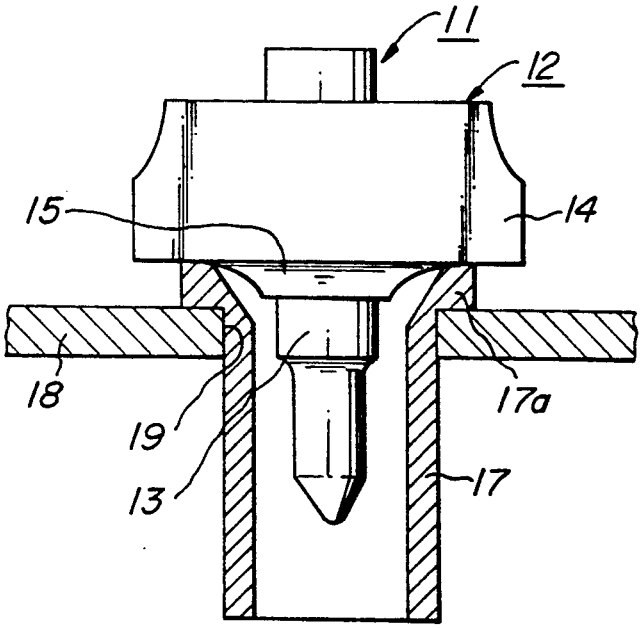
FIG. 2 is a schematic view illustrating one sintering step of a method of manufacturing a ceramic turbo charger rotor according to a second aspect of the invention.

FIG. 2 is a schematic view showing one sintering step of a method of manufacturing a ceramic turbo charger rotor according to a second aspect of the invention. In FIG. 2, a sintering step is performed for a ceramic turbo charger rotor formed body 11 made of silicon nitride, for example, obtained by using an injection molding method and the like. Comprising a back plate portion 15, a shaft portion 13 and a blade portion 12 having a shroud tip portion 14 under such a condition that the shaft portion 13 of the ceramic turbo charger rotor formed body 11 is inserted into a cylindrical support member 17 made of silicon nitride to support the back plate portion 15 by a support portion 17*a* of the support member 17 and then the support member 17, into which the ceramic turbo charger rotor formed body 11 is inserted, is further inserted into a through hole 19 arranged in a partition plate 18 made of silicon carbide, for example. The partition plates 18 may be arranged in a multistage manner.

In the first and second aspects of the invention, a contacted portion between the back plate portion 15 and the support portion 17*a* is ground after the sintering step shown in FIG. 2 to obtain the standard surface. Therefore, even if the contacted portion has a rough surface, a strength decrease due to the rough surface can be eliminated.

In the ceramic turbo charger rotor 1 according to a third aspect of the invention, the grinding operation after the sintering step is performed only for the shroud tip portion 4, the shaft portion 3 and a top portion 8, but not for the other portions of the blade portion 2. Therefore, the portions of the blade portion 2 other than the shroud tip portion 4, the shaft portion 3 and the top portion 8 are maintained in an as a fired state. In this case, since the grinding operation of a surface of the top portion 8 having a simple shape and a small area is easy as compared with the conventional ceramic turbo charger rotor, which must grind all the rear portion 7 and all the back plate portion 5, the grinding operation can be made easier. Moreover, in this embodiment, the standard surface for use in the measurement in working and installing steps is formed at a top surface of the top portion 8.

Figure 3:
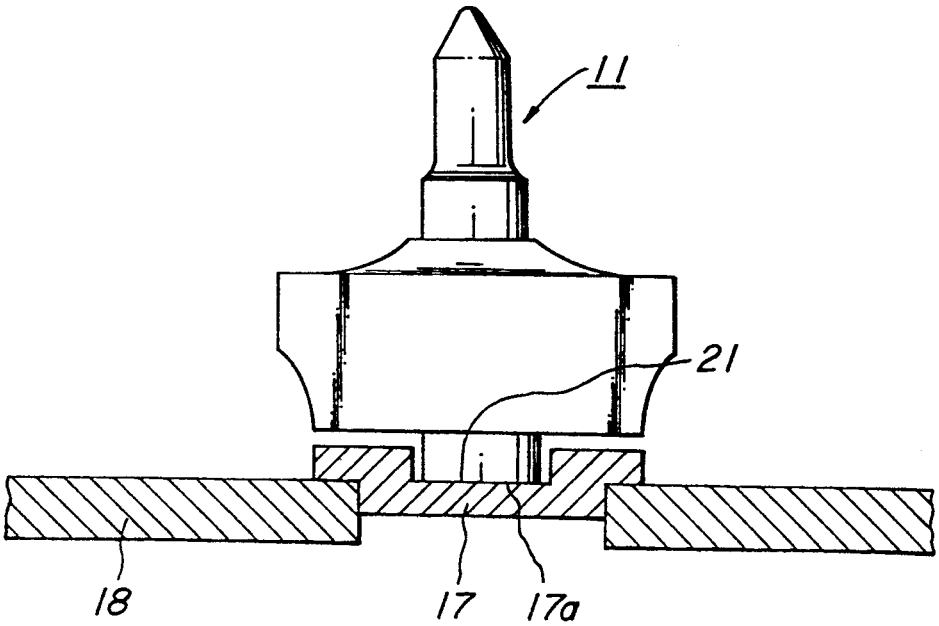
FIG. 3 is a schematic view depicting one sintering step of a method of manufacturing a ceramic turbo charger rotor according to a fourth aspect of the invention.

FIG. 3 is a schematic view showing one sintering step of a method of manufacturing a ceramic turbo charger rotor according to a fourth aspect of the invention. In FIG. 3, the sintering step is performed for the ceramic turbo charger rotor formed body 11 made of silicon nitride, for example obtained by using an injection molding method and the like, comprising the back plate portion 15, the shaft portion 18 and the blade portion 12 having a shroud tip portion 14 under such a condition that a top portion 20 of the ceramic turbo charger rotor formed body 11 is inserted into the support member 17 made of silicon nitride to support a tip surface 21 of the top portion 20 by the support portion 17*a* of the support member 17. The support member 17, into which the ceramic turbo charger rotor formed body 11 is inserted, is further inserted into the through hole 19 arranged in the partition plate 18 made of silicon carbide, for example. The partition plates 18 may be arranged in a multistage manner.

In the third and fourth aspects of the invention, a contacted portion between the top surface 21 and the support portion 17*a* is ground after the sintering step shown in FIG. 3 to obtain the standard surface. Therefore, even if the contacted portion has a rough surface, a strength decrease due to the rough surface can be eliminated.

Hereinafter, actual examples will be explained.

EXAMPLE 1

Raw materials, obtained by mixing $Si_3N_4$ powders having an average particle size of 0.5 μm and sintering agents, were granulated by means of a spray dryer. Then, with respect to 100 parts by weight of the thus granulated powders, 100 parts by weight of wax were mixed to obtain mixed powders and the mixed powders were extruded. After that, the once extruded body was injection-molded under a condition of 70° C., 400 kg/cm$^2$ to obtain a ceramic turbo charger rotor formed body having a maximum diameter of the blade portion of 55.5 mmϕ. Then, the ceramic turbo charger rotor formed body was preliminarily heated under such a condition of increasing temperature by 1° C./Hr from room temperature to 60° C., maintaining at 60° C. for 50 hours, maintaining from 60° C. to 180° C. for 20 hours and increasing temperature by 5° C./Hr from 180° C. to 450° C. to eliminate the wax.

After that, nine sintering boxes made of silicon carbide each comprising a cylinder made of silicon carbide having a diameter of 400 mmϕ and a height of 70 mm and a partition plate made of silicon carbide, in which through holes having a thickness of 12 mm were arranged, were stacked one by one. Then, support members made of silicon nitride having a flange outer diameter of 40 mmϕ, a flange inner diameter of 33 mmϕ and a height of 50 mm were arranged into the through holes respectively, and further the thus degreased ceramic turbo charger rotor formed bodies were set in the support members respectively. Then, the ceramic turbo charger rotor formed bodies were sintered in $N_2$ gas atmosphere at 1700° C.×1 Hr under the condition mentioned above to obtain ceramic turbo charger rotors.

With respect to the thus obtained ceramic turbo charger rotor, grinding operations according to the conventional method (in which not only the shroud tip portion and the shaft portion but also the rear portion and the back plate portion were ground) and to the method of the present invention (in which only a part of the back plate portion was ground for the standard surface except for the shroud tip portion and the shaft portion) were performed, and times and costs required for the grinding operations were measured and compared with each other. As for the grinding time, it is varied according to an amount of working, but, in one example, the conventional method requiring the grinder having shape substantially equal to the portion to be ground or the NC grinding operation needs about 10 minutes, while the method of the present invention needs only about 1 minute. As for the cost, the conventional method was 13 times more expensive per 1 set then, the method of the present invention since such a grinder or NC grinding operation must be required.

Further, after the grinding operations mentioned above, a rotation test such that a rotor is rotated at 130 thousands rpm for 100 hours by a combustion gas having a temperature of 900° C. was performed for the ceramic turbo charger rotor according to the conventional method in which all the back plate portion was ground and for the ceramic turbo charger rotor according to the method of the present invention in which only a part of the back plate portion was ground. As a result, both of them indicated no unusual states, showed the same rotation ability and could be used for an actual use.

EXAMPLE 2

Raw materials, obtained by mixing $Si_3N_4$ powders having an average particle size of 0.5 μm and sintering agents, were granulated by means of a spray dryer. Then, with respect to 100 parts by weight of the thus granulated powders, 100 parts by weight of wax were mixed to obtain mixed powders and the mixed powders were extruded. After that, the once extruded body was injection-molded under a condition of 70° C., 400 kg/cm$^2$ to obtain a ceramic turbo charger rotor formed body having a maximum diameter of the blade portion of 55.5 mmϕ. Then, the ceramic turbo charger rotor formed body was preliminarily-heated under such a condition of increasing temperature by 1° C./Hr from room temperature to 60° C., maintaining at 60° C. for 50 hours, maintaining from 60° C. to 180° C. for 20 hours and increasing temperature by 5° C./Hr from 180° C. to 450° C. to eliminate the wax.

After that, nine sintering boxes made of silicon carbide each comprising a cylinder made of silicon carbide having a diameter of 400 mmϕ and a height of 70 mm and a partition plate made of silicon carbide, in which through holes having a thickness of 12 mm were arranged, were stacked one by one. Then, support members made of silicon nitride having a flange outer diameter of 40 mmϕ, a flange inner diameter of 33 mmϕ and a height of 50 mm were arranged into the through holes respectively, and further the thus degreased ceramic turbo charger rotor formed bodies were set in the support members respectively. Then, the ceramic turbo charger rotor formed bodies were sintered in $N_2$ gas atmosphere at 1700° C.×1 Hr under the condition mentioned above to obtain ceramic turbo charger rotors.

Then, a test piece was cut out from an inner portion and an outer surface portion of the sintered body respectively, and a flexural strength of these pieces was measured on the basis of JIS R1601. From the above result, an average flexural strength of the test pieces based on the flexural strength standard of JIS R1601 was estimated from the following formula (1), and the estimated average flexural strengths were 700 MPa at the outer surface portion and 540 MPa at the inner portion.

$$\frac{\sigma_{v1}}{\sigma_{v2}} = \left(\frac{V_2}{V_1}\right)^{1/m} \quad (1)$$

wherein $\sigma_{v1}$: an average flexural strength of the test piece, $\sigma_{v2}$: an estimated flexural strength based on JIS R1601, $V_1$: an effective volume of the test piece, $V_2$: an effective volume of a test piece based on JIS R1601 and m: a Weibull coefficient of the test pieces.

With respect to the thus obtained ceramic turbo charger rotor, grinding operations according to the conventional method (in which not only the shroud tip portion and the shaft portion but also the rear portion and the back plate portion were ground) and to the method of the present invention (in which only a tip portion of the back plate portion was ground for the standard surface except for the shroud tip portion and the shaft portion) were performed, and times and costs required for the grinding operations were measured and compared with each other. As for the grinding time, it is varied according to an amount of working, but, in one example, the conventional method requiring the grinder having a shape substantially equal to the portion to be ground or the NC grinding operation needs about 10 minutes, while the method of the present invention needs only about 1 minute. As for the cost, the conventional method was 13 times more expensive 1 set than the method of the present invention, since such a grinder or NC grinding operation must be required.

Further, after the grinding operations mentioned above, a rotation test such that a rotor is rotated at 130 thousands rpm for 100 hours by a combustion gas having a temperature of 900° C. was performed for the ceramic turbo charger rotor according to the conventional method in which all the back plate portion was ground and for the ceramic turbo charger rotor according to the method of the present invention in which only a part of the tip portion was ground. As a result, both of them indicated no unusual states.

Moreover, an acceleration responsibility was observed in 2000 cc gasoline engine for respective turbo charger rotors by rapidly accelerating from 40 km/Hr at fourth gear, but no difference on the rotation ability can be detected. Therefore, the ceramic turbo charger rotors according to the invention showed the same rotation ability as that of the conventional one and could be used for an actual use.

As clearly understood from the above, according to the present invention, since the working is applied only for the portion used as the standard surface, it is possible to reduce portions to be worked and to make easy the working operation. As a result, the working cost, i.e. the total manufacturing cost, can be extraordinarily reduced while the strength is not decreased.

Moreover, according to the method of manufacturing the ceramic turbo charger rotor according to the invention, since only a part of the back plate portion or the top surface portion was ground as the standard surface by using the support member made of silicon nitride, the ceramic turbo charger rotor can be manufactured in an easy and inexpensive manner.

What is claimed is:

1. A ceramic turbo charger rotor comprising a blade portion including a shroud tip portion, a back plate portion arranged rear of said blade portion, and a shaft portion integral with an extending from said back plate portion, wherein only a part of said back plate portion is worked to provide a standard surface arranged in a plane substantially perpendicular to a rotational axis of said rotor, and remaining portions of said back plate portion are maintained in an as fired state.

2. A ceramic turbo charger rotor comprising a blade portion including a shroud tip portion and a top portion, a back plate portion arranged rear of said blade portion, and a shaft portion integral with and extending from said back plate portion, top surface portion of said top portion is worked to provide a standard surface, arranged in a plane substantially perpendicular to a rotational axis of said rotor, and remaining portions of said top portion and said back plate portion are maintained in an as fired state.

* * * * *